US007986904B2

(12) United States Patent
Okabe

(10) Patent No.: US 7,986,904 B2
(45) Date of Patent: Jul. 26, 2011

(54) IMAGE FORMING APPARATUS

(75) Inventor: Yasushi Okabe, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 355 days.

(21) Appl. No.: 12/360,868

(22) Filed: Jan. 28, 2009

(65) Prior Publication Data

US 2009/0190954 A1 Jul. 30, 2009

(30) Foreign Application Priority Data

Jan. 29, 2008 (JP) ..... 2008-017357

(51) Int. Cl.
*G03G 15/00* (2006.01)
*G03G 21/16* (2006.01)
*G03G 15/08* (2006.01)
*G03G 21/00* (2006.01)

(52) U.S. Cl. ..... 399/121; 399/110; 399/124

(58) Field of Classification Search ..... 399/110, 399/111, 121, 124
See application file for complete search history.

(56) References Cited

U.S. PATENT DOCUMENTS 6,978,103 B2 12/2005 Miura et al.
6,996,354 B2 2/2006 Kimura et al.
7,031,638 B2 * 4/2006 Tanizaki et al. ..... 399/112
2006/0140673 A1 6/2006 Kamimura et al.
2007/0048005 A1 * 3/2007 Nakano et al. ..... 399/110
2007/0231003 A1 * 10/2007 Shoji ..... 399/121

FOREIGN PATENT DOCUMENTS

JP 2000-147854 A 5/2000
JP 2003-287992 10/2003
JP 2003-316233 11/2003
JP 2004-094151 3/2004
JP 2006-184552 A 7/2006

OTHER PUBLICATIONS

JP Office Action dtd Nov. 24, 2009, JP Appln. 2008-017357, English translation.

* cited by examiner

*Primary Examiner* — David M Gray
*Assistant Examiner* — Joseph S Wong
(74) *Attorney, Agent, or Firm* — Banner & Witcoff, Ltd.

(57) ABSTRACT

In an image forming apparatus, a plurality of photoconductors arranged in the apparatus is supported by a support frame which is allowed to be pulled out from a body of the apparatus; and an endless intermediate transfer belt looped around a first roller and a second roller is in contact with each of the plurality of photoconductors. The first roller is supported by the body of the apparatus and retained in a position fixed relative to the body of the apparatus, and the support frame comprises a positioning portion which is configured to support a roller shaft of the second roller or a bearing part of the roller shaft of the second roller and to retain the intermediate transfer belt in a position fixed relative to the plurality of photoconductors.

8 Claims, 11 Drawing Sheets

IMAGE FORMING APPARATUS

CROSS-REFERENCE TO RELATED APPLICATION(S)

This application claims the foreign priority benefit under Title 35, United States Code, §119 (a)-(d), of Japanese Patent Application No. 2008-017357 filed on Jan. 29, 2008 in the Japan Patent Office, the disclosure of which is herein incorporated by reference in its entirety.

BACKGROUND OF THE INVENTION

1. Field of the Invention

The present invention relates to an image forming apparatus which includes a plurality of photoconductors and an endless intermediate transfer belt.

2. Description of Related Art

A particular type of image forming apparatus in which toner (developer) images retained on a plurality of photoconductors are transferred onto an intermediate transfer belt and then transferred from the intermediate transfer belt onto a recording sheet (of paper or the like) is known in the art. When this type of image forming apparatus is in use, the photoconductors are in contact with the intermediate transfer belt. Thus, the photoconductors or the intermediate transfer belt may be configured to be movable so that when any of the photoconductors is to be replaced, the photoconductor to be replaced and the intermediate transfer belt may be separated from each other. For instance, Patent Documents 1 and 2 listed below disclose image forming apparatuses in which an intermediate transfer belt (transfer member holding component) is retreated above and separated from photoconductors (image bearing members), and a support member (image bearing member holding component) for supporting the photoconductors is pulled out so as to render the photoconductors replaceable.

Patent Document 1: JP 2003-316233 A

Patent Document 2: JP 2003-287992 A

Note that US patent corresponding to these foreign patent documents issued under U.S. Pat. No. 6,978,103 B2.

In the image forming apparatus of the type as described above, it would be desirable that the photoconductors should be kept in positions fixed relative to the intermediate transfer belt when they are in operation. This is because inaccurate positioning of the photoconductors relative to the intermediate transfer belt would cause unnecessarily greater forces to act on both of the photoconductors and the intermediate transfer belt at their contact surfaces, or make a gap therebetween, which would undesirably produce a problem accurately transferring developer images from the photoconductors to the intermediate transfer belt, resultantly lowering the image quality (i.e., the quality of a developer image transferred onto a sheet).

However, each of the existing apparatuses as described above is configured to have the intermediate transfer belt supported by a body of the apparatus and the photoconductors supported by a support frame that is allowed to be pulled out from a body of apparatus. Therefore, it would be difficult to keep the photoconductors in appropriate positions fixed relative to the intermediate transfer belt.

In this respect, there is a need to provide an image forming apparatus in which the photoconductors can be positioned precisely and retained in positions fixed relative to the intermediate transfer belt. The present invention has been made in an attempt to answer the need. Illustrative, non-limiting embodiments of the present invention overcome the above disadvantage and other disadvantages not described above. Also, the present invention is not required to overcome the disadvantage described above, and an illustrative, non-limiting embodiment of the present invention may not overcome any problem described above.

SUMMARY OF THE INVENTION

In one aspect of the present invention, there is provided an image forming apparatus which comprises a plurality of photoconductors, a support frame, an endless intermediate transfer belt, and first and second rollers. The support frame is configured to support the plurality of photoconductors arranged in the apparatus, and is allowed to be pulled out from a body of the apparatus. The intermediate transfer belt is looped around the first and second rollers and is in contact with each of the plurality of photoconductors. The first roller is supported by a body of the apparatus and retained in a position fixed relative to the body of the apparatus. The support frame comprises a positioning portion which is configured to support a roller shaft of the second roller or a bearing part of the roller shaft of the second roller and to retain the intermediate transfer belt in a position fixed relative to the plurality of photoconductors.

With the image forming apparatus configured as described above, one of the rollers around which the intermediate transfer belt is looped (second roller) is retained in a position fixed relative to the support frame which supports the plurality of photoconductors, in that the roller shaft of the second roller or the bearing part of the roller shaft of the second roller is supported by the positioning portion of the support frame. Accordingly, the intermediate transfer belt can be more precisely positioned relative to the plurality of photoconductors in comparison with those of the existing apparatuses. Moreover, the other of the rollers (first roller) is supported and retained in a position fixed relative to the body of the apparatus, and thus the intermediate transfer belt can be more precisely positioned relative to a recording sheet conveyor mechanism (e.g., in a sheet feeder unit, a fixing unit, etc.).

According to the specific embodiments of the present invention as will be described below, the roller shaft of the second roller for the intermediate transfer belt or the bearing part of the roller shaft of the second roller is supported by the positioning portion of the support frame which supports the plurality of photoconductors, and thus the relative positions of the intermediate transfer belt and each of the plurality of photoconductors can be kept stably fixed. Consequently, the plurality of photoconductors can be positioned precisely relative to the intermediate transfer belt, and the loss of image quality can be prevented.

BRIEF DESCRIPTION OF THE DRAWINGS

The above aspect and advantages, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

Figure 1:
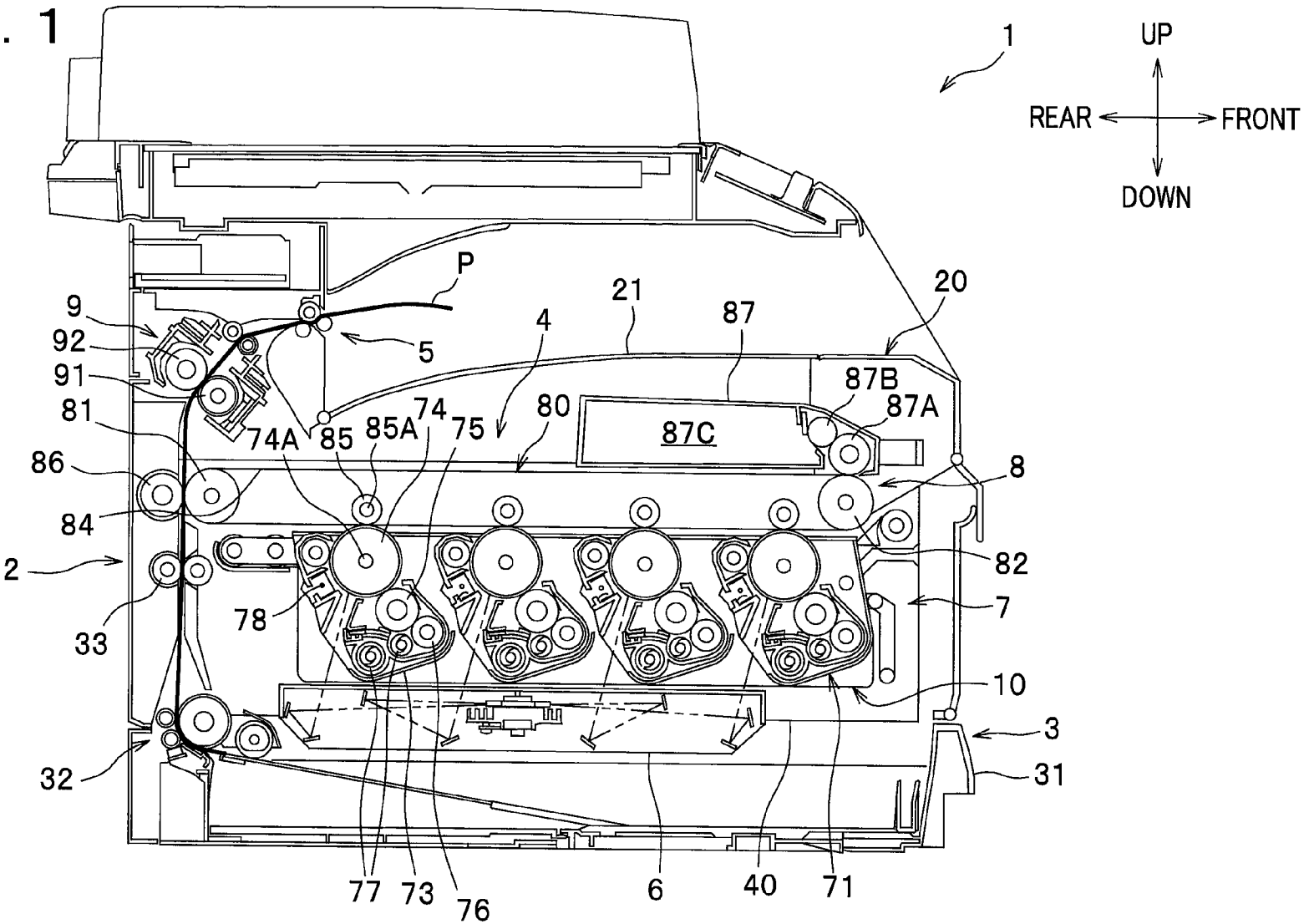
FIG. 1 is a schematic diagram of a color printer (all-in-one or multifunction printer) as one example of an image forming apparatus according to an exemplary embodiment of the present invention.

A detailed description will be given of exemplary embodiments of the present invention with reference to the drawings. In the following description, the direction is designated as from the viewpoint of a user who is using (operating) a color printer. To be more specific, in FIG. 1, the right-hand side of the drawing sheet corresponds to the "front side" of the color printer (image forming apparatus), and the left-hand side of the drawing sheet corresponds to the "rear side" of the color printer, the front side of the drawing sheet corresponds to the "left side" of the color printer, and the back side of the drawing sheet corresponds to the "right side" of the color printer. Similarly, the direction of a line extending from top to bottom of the drawing sheet corresponds to the "vertical direction" of the printer.

As shown in FIG. 1, a color printer 1 comprises a body casing 2 which makes up a main body of the printer 1, and the other components housed within the body casing 2 principally includes a sheet feeder unit 3, an image forming unit 4 and a sheet output unit 5. The sheet feeder unit 3 is configured to feed a sheet P (recording sheet, of paper or the like) to the image forming unit 4. The image forming unit 4 is configured to form an image on a sheet P fed from the sheet feeder unit 3. The sheet output unit 5 is configured to eject a sheet P on which an image has been formed in the image forming unit 4 to the outside of the body casing 2. Provided at a top side of the body casing 2 is a sheet output tray 21 which is configured to receive sheets P ejected by the sheet output unit 5 one by one through the body casing 2 so that the ejected sheets P are stacked and accumulated in the sheet output tray 21.

The sheet feeder unit 3 includes a sheet feed tray 31, a sheet feed mechanism 32, and a pair of registration rollers 33. The sheet feed tray 31 is provided in a lower space within the body casing 2, and is detachably attached to the body casing 2. The sheet feed mechanism 32 is configured to separate one sheet P from the sheets stacked in the sheet feed tray 31 and feed the separated sheet P upward to the registration rollers 33. The sheet feed mechanism 32 is composed of known components which include a sheet feed roller, a separation roller, a separation pad, a paper powder remover roller, etc. (reference numerals of which are omitted). The sheet P thus fed from the sheet feed mechanism 32 is put in proper alignment, so that the edge of the sheet P is neatly aligned, by the registration rollers 33, and is then conveyed upward to the image forming unit 4.

The image forming unit 4 principally includes a scanner unit 6, a process unit 7, a transfer unit 8 and a fixing unit 9.

The scanner unit 6 is provided in a lower space within the body casing 2, to be more specific, between the sheet feed tray 31 and the process unit 7, and composed of known components which include a laser light-emitting device, a polygon mirror, a plurality of lenses and a plurality of reflecting mirrors (reference numerals of which are omitted). In the scanner unit 6, according to the present embodiment, laser beams for cyan, magenta, yellow and black emitted from four laser light-emitting devices of the corresponding colors travel paths as indicated by chain double-dashed lines of FIG. 1, and strike the corresponding photoconductor drums 74 in the process unit 7, respectively.

The process unit 7 is disposed above the scanner unit 6, to be more specific, between the scanner unit 6 and the transfer unit 8, and includes a support frame 10, a plurality of (four in this embodiment) development devices 71 arranged in the support frame 10, and a plurality of developer cartridges 72 (see FIG. 2) disposed at a left side of the support frame 10 (at a left side of a left side frame 40 of the body casing 2) and detachably attached to the body casing 2.

The support frame 10 is installed in the body casing 2 in such a manner that the support frame 10 can be pulled out in a front-rear direction from the body casing 2. The four development devices 71 are arranged in the support frame 10 in the front-rear direction. A detailed description of the construction and operation of the support frame 10 will be given later.

Figure 2:
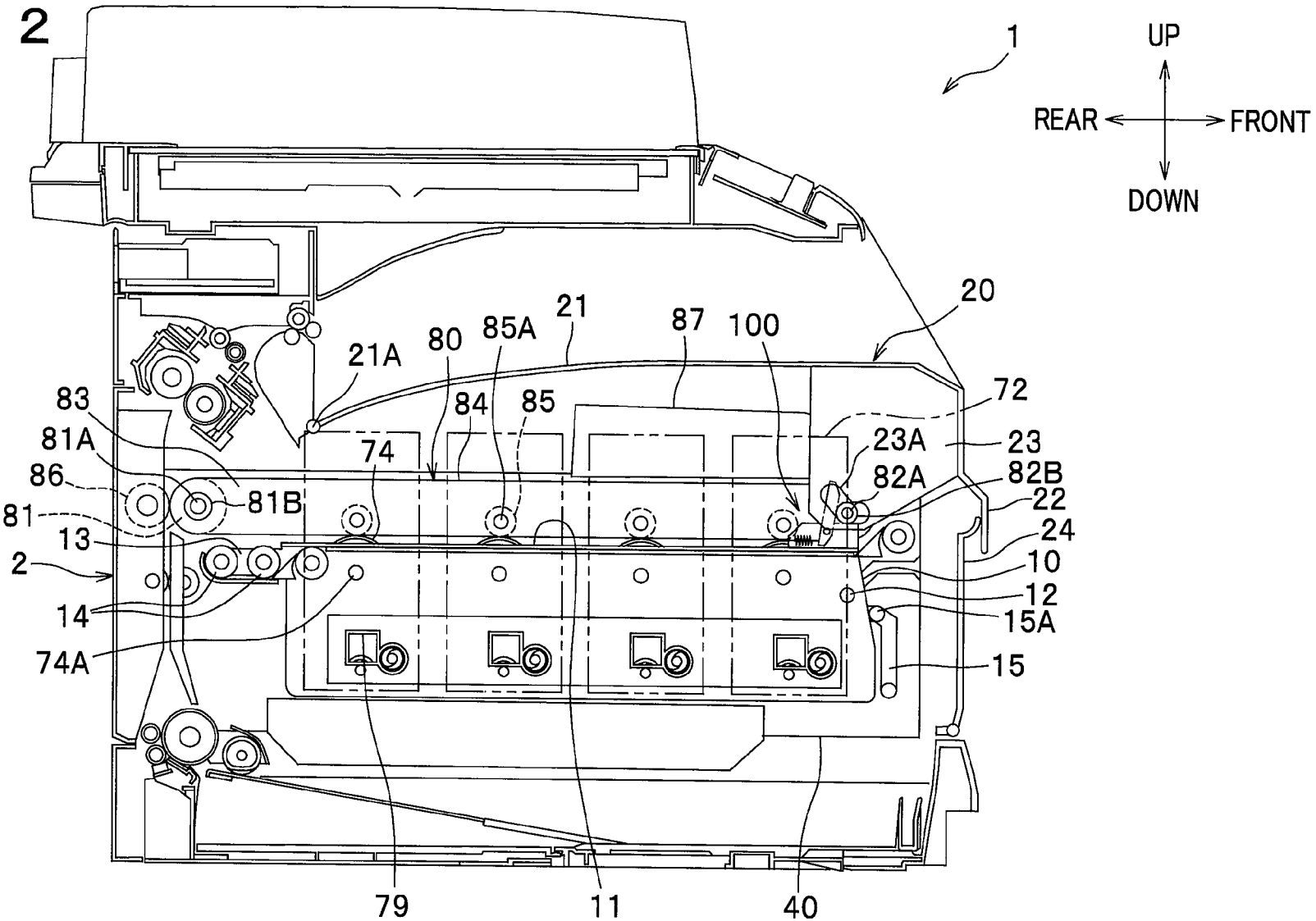
FIG. 2 is a diagram structurally illustrating an upper cover and a support frame of the color printer of FIG. 1.

Each of the development devices 71 principally includes a device case 73, a photoconductor drum 74 as one example of a photoconductor, a development roller 75, a supply roller 76, a pair of conveyor augers 77 and a charger 78; these components 74, 75, 76, 77 and 78 are provided in the device case 73. Each photoconductor drum 74 has its rotation shaft 74A supported by the support frame 10 as shown in FIG. 2.

Provided in left sidewalls of the device cases 73 abutting face-to-face on the left side panel of the support frame 10 at their lower portions are openings 79 each of which connects the inside and outside of the development device 71. Each opening 79 is connected with an opening (not shown) formed in a corresponding developer cartridge 72. Toner (developer) in the developer cartridge 72 is allowed to be supplied through the opening of the developer cartridge 72 and the opening 79 to the corresponding development device 71, and to be circulated back from the development device 71 to the developer cartridge 72 therethrough. The development devices 71 are different from one another solely in color of toner to be supplied from the corresponding developer cartridge 72, and have substantially the same construction.

In the process unit 7 configured as described above, an outer cylindrical surface of each photoconductor drum 74 is uniformly charged by the corresponding charger 78, and is then selectively illuminated with a laser beam emitted from the scanner unit 6, so that a potential of an illuminated area of the surface of the photoconductor drum 74 is lowered to form an electrostatic latent image thereon in accordance with image data. Meanwhile, toner in each developer cartridge 72 shown in FIG. 2 is supplied through the opening 79 into the corresponding development device 71, and the toner supplied into the development device 71 is forwarded by the conveyor augers 77 and the supply roller 76 to the development roller 75. The toner thus supplied to the development roller 75 is then supplied to the surface of the photoconductor drum 74 and retained selectively on that area of the photoconductor drum 74 in which an electrostatic latent image has been formed, to thereby visualize the electrostatic latent image, forming a toner image thereon.

The transfer unit 8 is disposed, as shown in FIG. 1, above the process unit 7, and principally includes a driving roller 81 as one example of a first roller, a driven roller 82 as one example of a second roller, a belt frame 83 (see FIG. 2), an intermediate transfer belt 84, four primary transfer rollers 85, a secondary transfer roller 86, and a cleaning unit 87 as one example of a residual developer collecting member. The driven roller 82 is disposed at a front side (in a first position closer to a first end of the support frame 10 facing toward a pull-out direction in which the support frame 10 is allowed to be pulled out), and the driving roller 81 is disposed at a rear side (in a second position closer to a second end of the support frame 10 facing toward a direction opposite to the pull-out direction).

In the following discussion, the driving roller 81, driven roller 82, belt frame 83, intermediate transfer belt 84, primary transfer roller 85 and cleaning unit 87 constitute an assembly which will be referred to as a belt unit 80.

The driving roller 81 and the driven roller 82 laid with their axes extending laterally in parallel are arranged separately and supported by the belt frame 83 in front and rear positions in the body casing 2 (see FIG. 2). The intermediate transfer belt 84 in the form of an endless belt is looped around the driving roller 81 and the driven roller 82. The intermediate transfer belt 84 is driven by the rotary motion of the driving roller 81 and is rotated together with the driven roller 82.

A roller shaft of the driving roller 81 is supported by bearing parts 81B which are in turn supported by the body casing 2 and thus retained in a position fixed relative to the body casing 2. The belt unit 80 is configured to be swingable on a roller shaft (pivot shaft 81A), as an axis of rotation, of the driving roller 81, upward and downward together with an upper cover 20 that will be described later (see FIG. 3).

Each of the primary transfer rollers 85 is provided inside the intermediate transfer belt 84 in a position directly opposite to a corresponding photoconductor drum 74 such that the intermediate transfer belt 84 is held between the primary transfer roller 85 and the corresponding photoconductor drum 74. Each primary transfer roller 85 is supported, rotatably on its rotation shaft 85A, by the belt frame 83 (see FIG. 2). During transfer operation, a transfer bias is applied to each primary transfer roller 85 by a constant-current control. Accordingly, toner images formed on the respective photoconductor drums 74 are transferred, one on top of another, onto the intermediate transfer belt 84.

The secondary transfer roller 86 is disposed rearwardly opposite to the driving roller 81 with the intermediate transfer belt 84 held between the secondary transfer roller 86 and the driving roller 81. The secondary transfer roller 86 is pressed to the front, i.e., against the driving roller 81, by a spring (not shown) provided in the body casing 2. A transfer bias is also applied to the secondary transfer roller 86 by a constant-current control during the transfer operation. Accordingly, the toner image on the intermediate transfer belt 84 is transferred onto a sheet P conveyed upwardly from the registration rollers 33.

The cleaning unit 87 is disposed above the intermediate transfer belt 84, and is configured to collect residual toner adhering to the intermediate transfer belt 84 by means of a first cleaning roller 87A and a second cleaning roller 87B and to store the collected toner in a toner reservoir 87C.

The fixing unit 9 is disposed along a sheet conveyance path downstream of the transfer unit 8, to be more specific, above the secondary transfer roller 86, and principally includes a heating roller 91 and a pressure roller 92, which are configured as known in the art. In the fixing unit 9, a toner image formed on a sheet P is thermally fused and fixed on the sheet P through the process of pinching and forwarding the sheet P between the heating roller 91 and the pressure roller 92, the toner image is thermally fused and fixed on the sheet P.

The sheet output unit 5 includes a plurality of conveyor rollers (reference numerals of which are omitted). The sheet P output from the fixing unit 9 is conveyed and ejected by the conveyor rollers to the outside of the body casing 2, and stacked and accumulated on the sheet output tray 21.

Referring now to FIGS. 3-6, a unique structure for positioning the intermediate transfer belt 84 relative to the photoconductor drums 74 as implemented in accordance with the present embodiment will be described in detail.

As shown in FIG. 2, the body casing 2 principally includes an upper cover 20, a front cover 24 which is configured to be swingable frontward and rearward on a pivot provided at a lower end thereof, and side frames 40 configured to support the support frame 10 in a manner that permits the support frame 10 to be pulled out from the body casing 2. The body casing 2 is configured to support the bearing parts 81B which are in turn configured to support the roller shaft (pivot shaft 81A), as an axis of rotation, of the driving roller 81 in a manner that permits the roller shaft of the driving roller 81 to rotate. That is, the driving roller 81 is supported by the body casing 2 and retained in a position fixed relative to the body casing 2.

The upper cover 20 is a member which makes up an upper portion of the body casing 2 and, to be more specific, is provided above the process unit 7. The upper cover 20 principally includes a sheet output tray 21 formed at a top side thereof, a front panel 22 provided at a front side thereof, and support panels 23 provided at right and left sides of a front portion thereof. The upper cover 20 has a pivot shaft 21A provided at a rear end of the sheet output tray 21 below the sheet output unit 5 and supported by the body casing 2, such that the upper cover 20 can be swung upward on the pivot shaft 21A as an axis of the swinging motion (see FIG. 3). The belt unit 80 is disposed inside the upper cover 20.

Each of the support panels 23 has an oblong support hole 23A elongated obliquely in an upward and rearward direction as viewed when the upper cover 20 is in a closed position. In this embodiment, to be more specific, the support hole 23A is composed of a sloped portion and a horizontally extending portion, and is bent or curved at a rear end of the horizontally extending portion, from which the sloped portion extends obliquely in the upward and rearward direction. Bearing parts 82B for supporting the roller shaft 82A of the driven roller 82 in a manner that permits the driven roller 82 to rotate are loosely fitted in the support holes 23A of the support panels 23, respectively. In this way, the front side of the belt unit 80 is supported by the upper cover 20, and the bearing parts 82B are rendered movable relative to the support panels 23 between a position closer to the pivot shaft 21A and a position away from the pivot shaft 21A within the support holes 23A.

Figure 3:
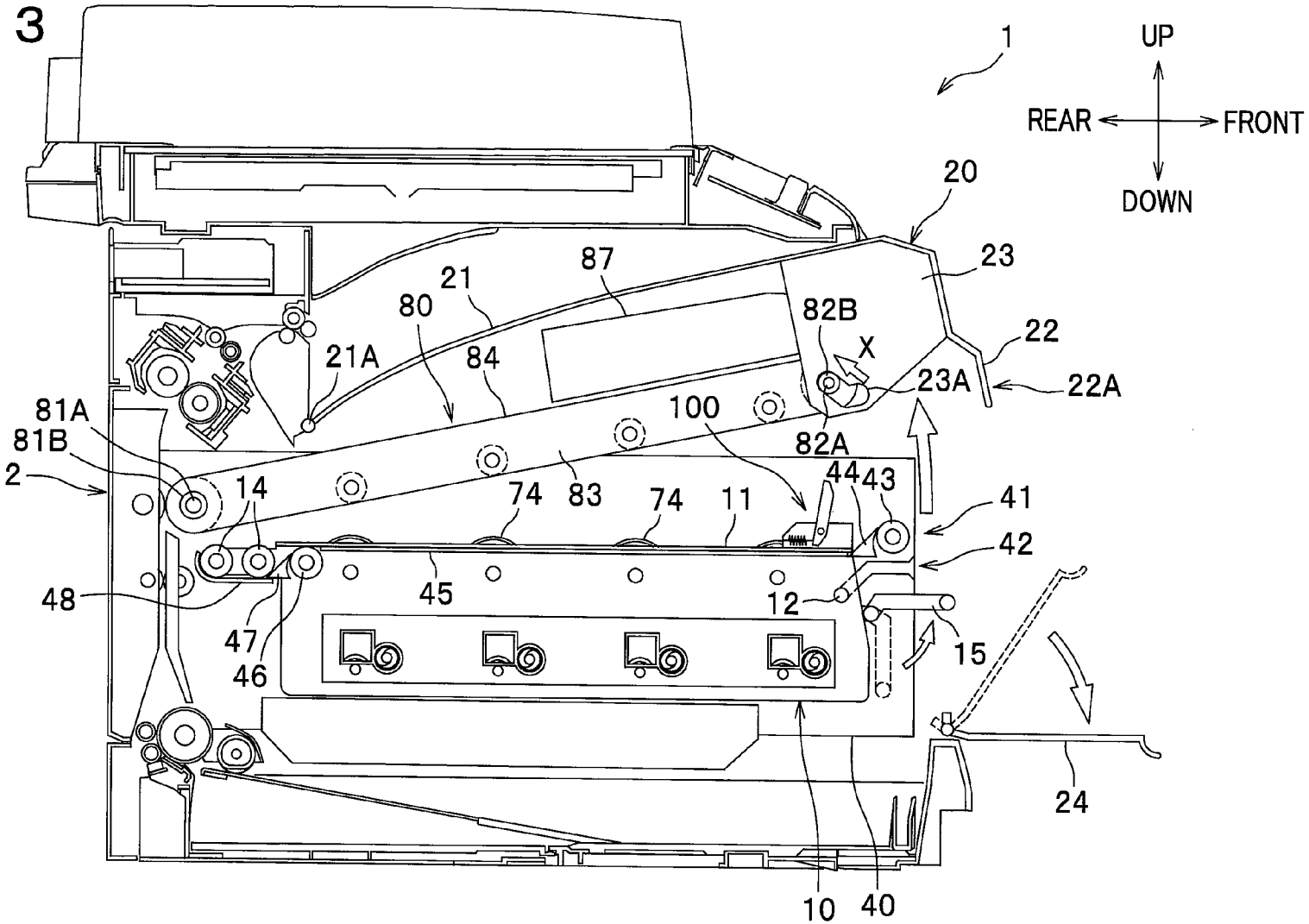
FIG. 3 is a diagram illustrating a state in which the upper cover and a front cover of the color printer of FIG. 1 have been swung open.

With this configuration, as the upper cover 20 is swung, the belt unit 80 (intermediate transfer belt 84) is swung (moved) on the pivot shaft 81A (that coincides with an axis of rotation of the driving roller 81) between a contact position as shown in FIG. 2 in which the intermediate transfer belt 84 is in contact with each of the photoconductor drums 74 and a separate position as shown in FIG. 3 in which the intermediate transfer belt 84 is separate from the each of the photoconductor drums 74. In this operation, the cleaning unit 87 disposed above the intermediate transfer belt 84 is also moved together with the intermediate transfer belt 84.

As shown in FIG. 3, the side frames 40 are provided at right and left sides of the support frame 10 installed in the body casing 2. Each side frame 40 comprises a guideway portion 41 and a guide slot 42.

The guideway portion 41 is a portion along which a flange 11 and guide rollers 14 of the support frame 10, which will be described later, are guided when the support frame 10 is installed into or removed from the body casing 2. The guideway portion 41 comprises, from the front, a first roller 43, a first sloped portion 44, a guide rail 45, a second roller 46, a second sloped portion 47, and a retaining portion 48. An upper surface (rolling surface) of the first roller 43, an upper surface of the first sloped portion 44, an upper surface of the guide rail 45, an upper surface (rolling surface) of the second roller 46, and an upper surface of the second sloped portion 47 are arranged to constitute a single continuous guide surface.

The guide slot 42 is a portion for guiding and positioning a projection 12 of the support frame 10, which will be described below.

The support frame 10 is shaped like a box with its upper side open, and as shown in FIG. 2 comprises: a flange 11, a projection 12, a roller mount portion 13 and guide rollers 14 which are provided at each side panel; a handle 15 which is provided at a front side; and a positioning portion 100 which is provided on an upper surface of each flange 11.

Right and left flanges 11 are formed by bending upper end portions of the right and left panels of the support frame 10 outward (rightward and leftward, respectively) substantially at right angles. Right and left positioning portions 100 are provided on the upper surfaces of the right and left flanges 11, respectively, in positions closer to the front ends of the flanges 11.

Right and left projections 12 each having the shape of a circular cylinder projecting outward (rightward and leftward, respectively) from the outer surfaces of the right and left panels are provided in positions closer to the front ends of the right and left panels.

Right and left roller mount portions 13 are provided which extend rearward from upper portions of the rear ends of the right and left panels. On each of the roller mount portions 13, two rotatable guide rollers 14 projecting outward (rightward or leftward) are arranged in the front-rear direction.

The handle 15 is a part designed specifically to be grasped by a user who is about to pull out the support frame 10, and is provided at the front side of the support frame 10. The handle 15 is swingably joined to the front side of the support frame 10 by means of a pivot shaft 15A so that the handle 15 can be folded down about the pivot shaft 15A when the support frame 10 has been installed in the body casing 2.

With the configuration as described above, the Support frame 10 can be pulled out from the body casing 2. To be more specific, as shown in FIG. 3, an overhang 22A provided in the front panel 22 is held (with user's fingers slid thereunder) and the upper cover 20 is swung upwardly so that the intermediate transfer belt 84 is moved to the separate position. Then, the front cover 24 is frontwardly and downwardly swung open, and the handle 15 is swung frontward and upward so that the grip of the handle 15 is moved into a substantially horizontal position.

Figure 4:
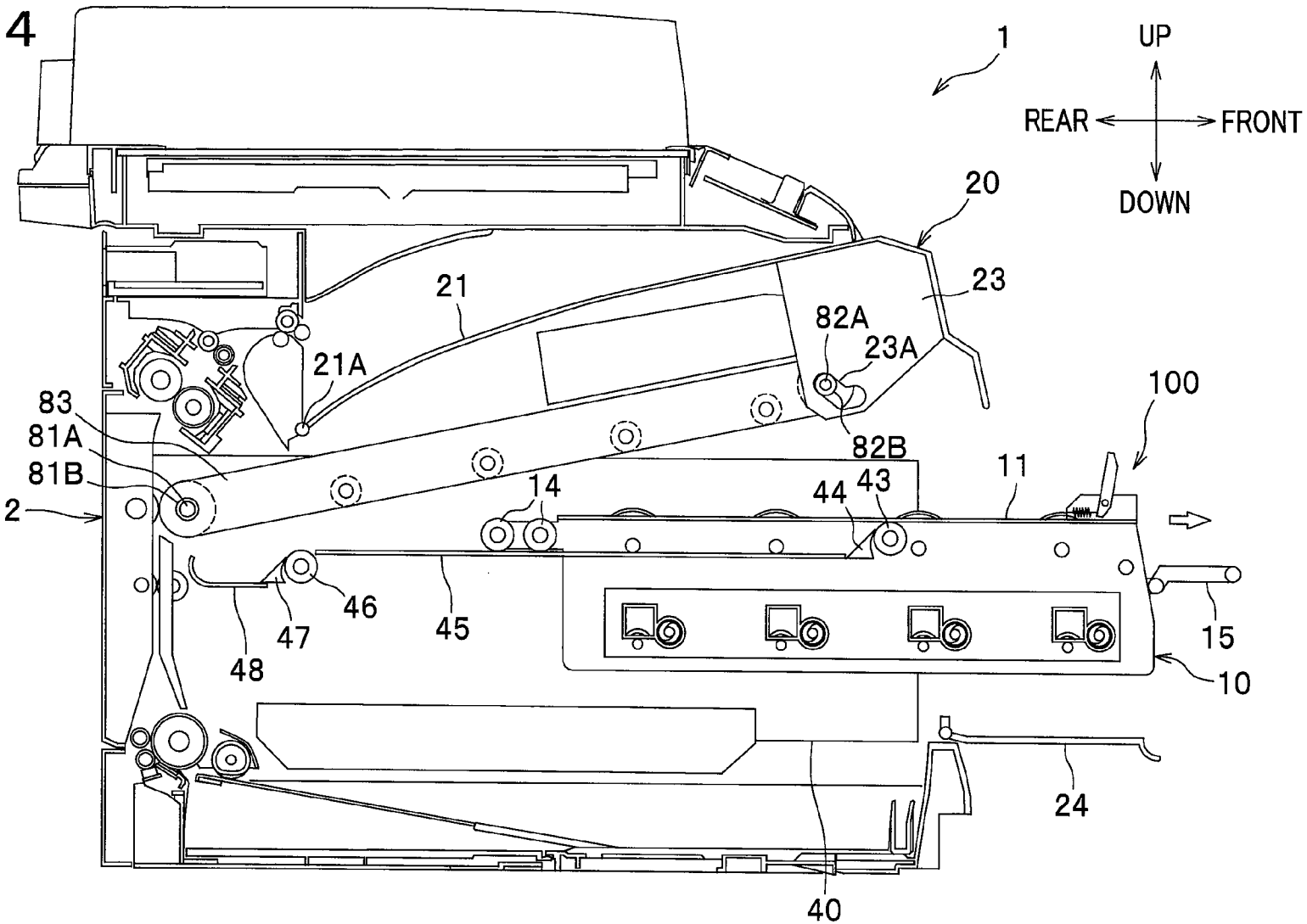
FIG. 4 is a diagram illustrating a state in which the support frame of the color printer of FIG. 1 is being pulled out.

Next, as shown in FIG. 4, the handle 15 is grasped and pulled to the front. Then, the flanges 11 move on the second rollers 46 and the first rollers 43, causing the rollers 46, 43 to roll under the flanges 11, and the guide rollers 14 roll on the guide surfaces of the guideway portions 41. In this way, the support frame 10 can be pulled out smoothly from the body casing 2.

When the support frame 10 is further pulled to the front though not shown in the drawing figures, the support frame 10 can be pulled out completely from the body casing 2. In this way, the support frame 10 can be removed from the body casing 2. When the support frame 10 is renewed or replaced and re-installed into the body casing 2, similarly, the flanges 11 move on the first rollers 43 and the second rollers 46, causing the rollers 43, 46 to roll under the flanges 11, and the guide rollers 14 roll on the guide surfaces of the guideway portions 41, so that the support frame 10 can be installed smoothly into the body casing 2.

When the support frame 10 is installed into the body casing 2, the projections 12 are guided along the guide slots 42, and the projections 12 come in contact with the rear ends of the guide slots 42, so that the front position of the support frame 10 is fixed in an appropriate position relative to the body casing 2, as shown in FIG. 3. Meanwhile, the guide rollers 14 come in contact with the rear ends of the retaining portions 48, so that the rear position of the support frame 10 is fixed in an appropriate position relative to the body casing 2. Furthermore, the undersides of the flanges 11 are so positioned as to abut against the upper surfaces of the guide rails 45, with the result that the support frame 10 is supported in the body casing 2 in a stable state.

Figure 5:
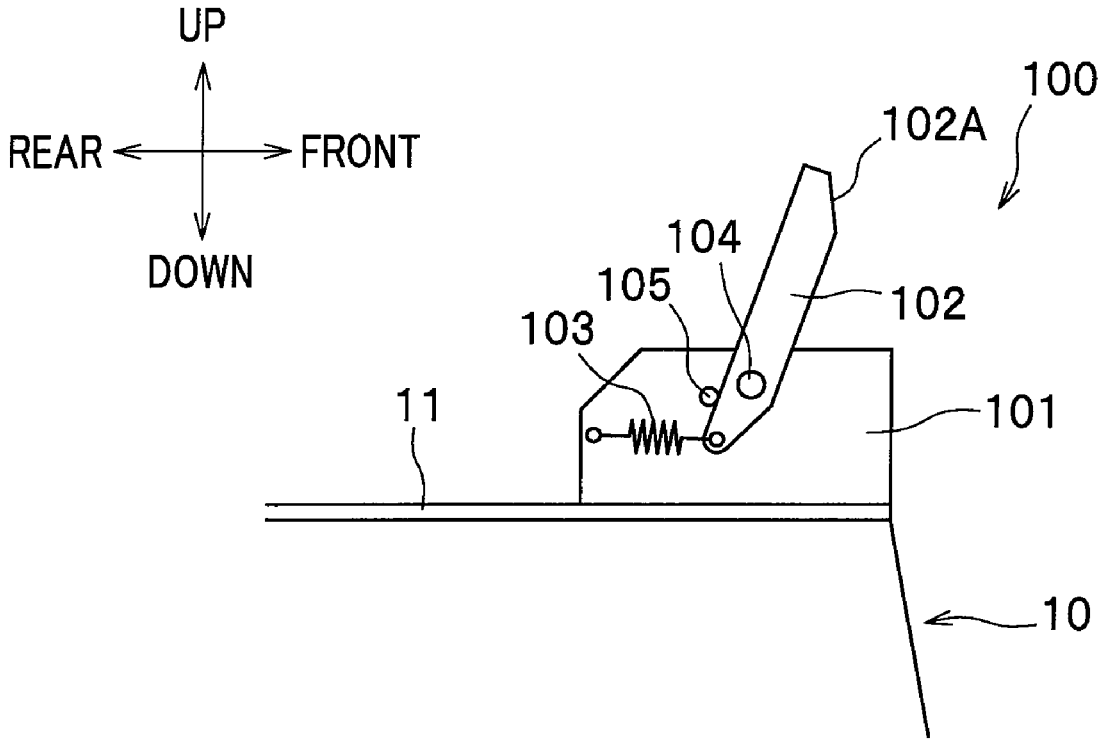
FIG. 5 is a side elevation showing a structure of a positioning portion provided on the support frame according to an exemplary embodiment of the present invention.
Figure 6:
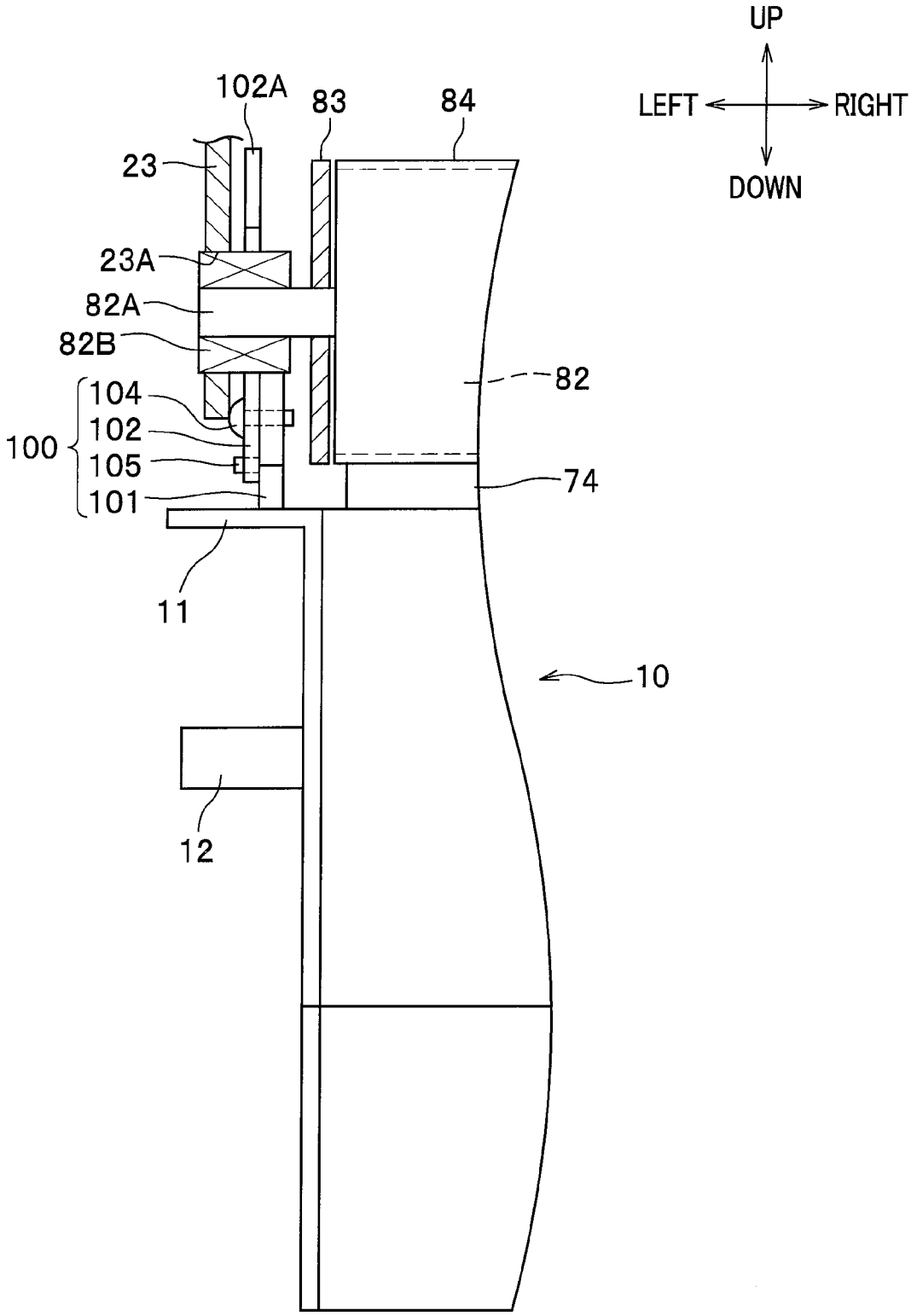
FIG. 6 is a front elevation of the positioning portion of FIG. 5.

As shown in FIGS. 5 and 6, each positioning portion 100 is positioned between the corresponding support panel 23 and the corresponding belt frame 83 when the intermediate transfer belt 84 is in the contact position. The positioning portion 100 principally includes a positioning plate 101, a pressure plate 102 and a helical extension spring 103. The pressure plate 102 and the extension spring 103 in combination serve as a tensioner in the present embodiment.

The positioning plate 101 is a plate-like member provided on the flange 11, and positioned in a position closer to the front end of the flange 11, such that the bearing part 82B is in contact with an upper end of the positioning plate 101 when the intermediate transfer belt 84 is in the contact position.

The pressure plate 102 is positioned between the support panel 23 and the positioning plate 101 when the intermediate transfer belt 84 is in the contact position. The pressure plate 102 is swingably supported on a pivot shaft 104 provided in the positioning plate 101. At an upper portion of the pressure plate 102, in a position closer to the front end thereof, a sloped surface 102A is formed so as to guide the corresponding bearing part 82B of the driven roller 82 for the intermediate transfer belt 84 when the intermediate transfer belt 84 is moving from the separate position to the contact position.

The extension spring 103 has one end attached to a lower end of the pressure plate 102 and the other end attached to a rear end of the positioning plate 101. With this arrangement, when the upper portion of the pressure plate 102 is pushed and moved rearward, the upper portion of the pressure plate 102 is pulled frontward by the action of the extension spring 103. It is to be understood that the swinging motion of the pressure plate 102 is restricted by a stopper 105 protruding outward from the positioning plate 101 so as not to go beyond a position indicated in FIG. 5.

Operation and advantages of the color printer 1, especially, of the positioning portion 100, configured as described above will be described hereafter with reference particularly to FIG. 7.

When the support frame 10 is installed into the body casing 2 (see FIG. 3), first, the handle 15 is folded down and the front cover 24 is swung upward to close the opening. Next, the upper cover 20 is swung downward so that the intermediate transfer belt 84 is moved from the separate position to the contact position (see FIG. 2).

Figure 7:
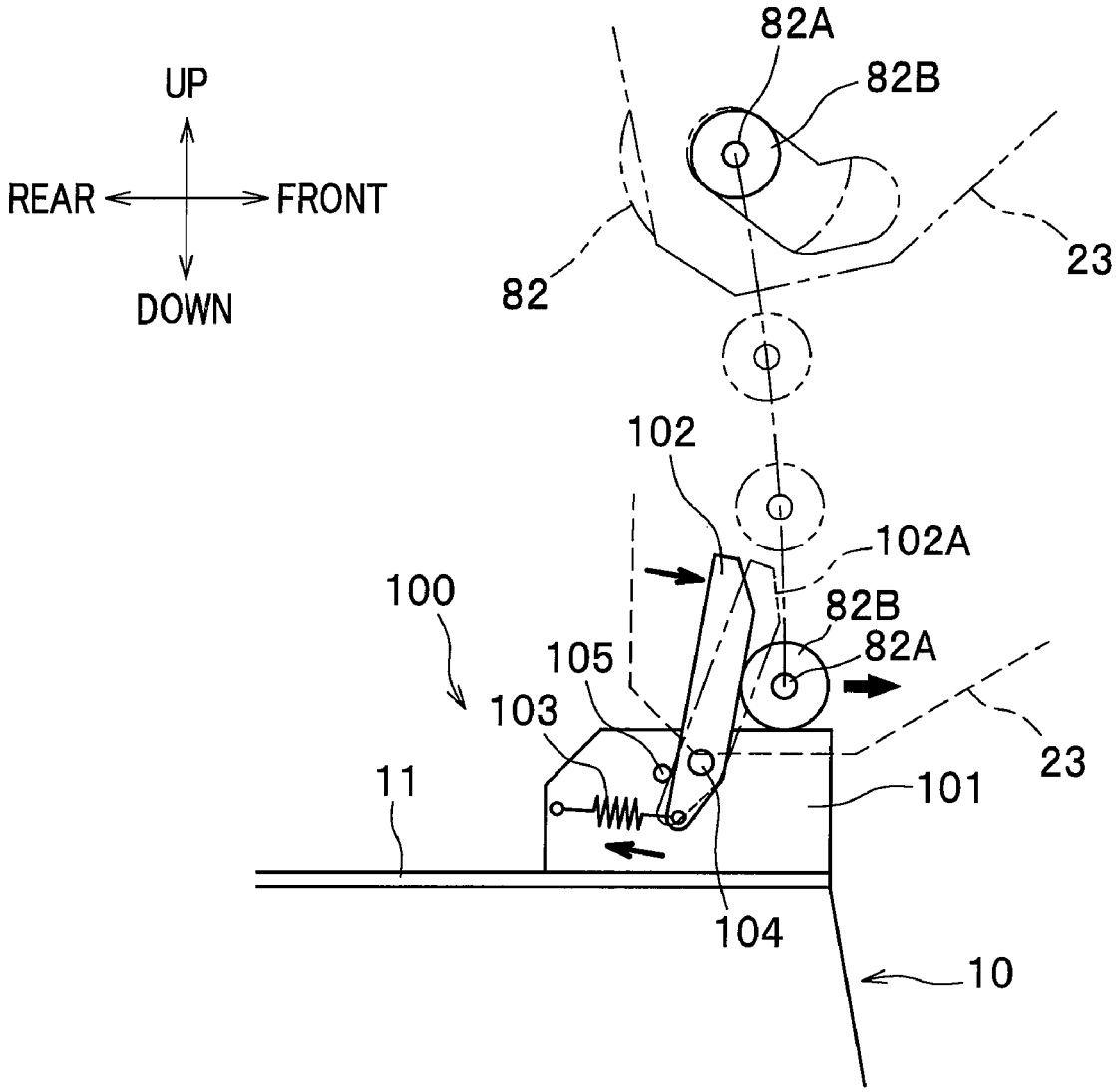
FIG. 7 is a diagram for explaining an operation of the positioning portion of FIG. 5.

In this operation, each bearing part 82B of the driven roller 82 of the intermediate transfer belt 84 is moved downward along a path indicated by alternate long and short dashed lines in FIG. 7, and brought into contact with the upper end of the corresponding positioning plate 101. To be more specific, the bearing part 82B comes in contact with the upper end surface of the pressure plate 102, and then with the sloped surface 102A thereof. As the bearing part 82B moves downward along the sloped surface 102A, the bearing part 82B pushes the upper portion of the pressure plate 102 rearward, and as a lower portion of the pressure plate 102 moves accordingly, the extension spring 103 is thereby stretched frontward.

As the bearing part 82B having passed by the sloped surface 102A is further moved downward, the upper portion of the pressure plate 102 pushes the bearing part 82B frontward by the action (resilience or restoring force) of the extension spring 103. In this way, as the driven roller 82 is being separated from the driving roller 81, a tension applied to the intermediate transfer belt 84 gradually increases. Accordingly, the bearing part 82B moves downward while applying a tension to the intermediate transfer belt 84, and comes in contact with the upper end of the positioning plate 101.

Since the bearing part 82B comes in contact with the upper end of the positioning plate 101, the vertical position of the driven roller 82 is fixed in an appropriate position relative to the support frame 10. Since the bearing part 82B is pressed frontward by the upper portion of the pressure plate 102, a tensioning force is applied to the intermediate transfer belt 84, and the front-rear position of the driven roller 82 is fixed in an appropriate position relative to the support frame 10.

In this way, in the color printer 1 according to the present embodiment, the positioning portion 100 serves to retain the position of the intermediate transfer belt 84 relative to the support frame 10, and thus the intermediate transfer belt 84 can be positioned relative to each of the photoconductors 74 supported by the support frame 10, more precisely than the existing apparatus in which an intermediate transfer belt is supported by the main body or body casing of the apparatus and retained in position with respect thereto. Moreover, since the driving roller 81 is supported by the bearing part 81B which is in turn supported by the body casing 2 and thus retained in position with respect to the body casing 2 in the present embodiment, the position of the driving roller 81 can be fixed in an appropriate position relative to the conveyor mechanism for sheets P (e.g., sheet feeder unit 3 and fixing unit 9, etc.) with high precision.

To be more specific, since the driving roller 81 is supported by the bearing part 81B and positioned relative to the body casing 2, and the driven roller 82 is supported by the bearing part 82B and positioned relative to the positioning portion 100 of the support frame 10, the intermediate transfer belt 84 can be positioned with high precision in two aspects: (1) the position of the intermediate transfer belt 84 relative to the secondary transfer roller 86 can be fixed appropriately; and (2) the position of the intermediate transfer belt 84 relative to the frontmost photoconductor drum 74, which is located remote from the center of swinging motion (pivot 81A) of the intermediate transfer belt 84 and thus would otherwise not be adjusted with precision, can be fixed appropriately. Accordingly, the position of the intermediate transfer belt 84 relative to each of the photoconductor drums 74 and relative to the secondary transfer roller 86 can be retained unchangeable more reliably, and thus the quality of images formed on a sheet P can be maintained at an adequate level.

Since the intermediate transfer belt 84 is configured to be swingable on the pivot shaft 81A that is the roller shaft of the driving roller 81, the support frame 10 can be pulled out from the body casing 2 with ease, while the position of the driving roller 81 relative to the body casing 2 can be maintained unchangeable between two points of time prior to and subsequent to the swinging motion of the intermediate transfer belt 84. Accordingly, the intermediate transfer belt 84 can be swung while being kept in a position fixed relative to the secondary transfer roller 86, and thus the conditions of secondary transfer can be maintained unchanged. Thus, the quality of images can be maintained at an adequate level.

Since a tension is applied to the intermediate transfer belt 84 by the pressure plate 102 and the tension spring 103, the balance of forces acted between the intermediate transfer belt 84 and each of the photoconductor drums 74 at their contact surfaces can be maintained properly, and thus the quality of images formed on a sheet P can be maintained more stably at an adequate level.

Furthermore, since the driven roller 82 (bearing part 82B) is pushed by the pressure plate 102 and the extension spring 103 in a direction away from the driving roller 81, its reaction force acts on the pressure plate 102 which in turn produces a force urging the positioning plate 101 and thus the support frame 10 rearward. In this way, the projection 12 is pressed against the rear end of the guide slot 42, so that the support frame 10 can be reliably retained in an appropriate position relative to the body casing 2. Consequently, each of the photoconductor drums 74 (support frame 10) and the intermediate transfer belt 84 (bearing part 82B) can be precisely positioned relative to each other. It is to be understood that the support frame 10 can be positioned by the rear guide rollers 14 being pressed against the rear ends of the retaining portions 48.

In the present embodiment, the cleaning unit 87 is configured to be swingable together with the intermediate transfer belt 84, and thus the cleaning unit 87 does not have to be removed when the intermediate transfer belt 84 (upper cover 20) is to be swung. Moreover, the pivot shaft 81A (and the pivot shaft 21A) in the present embodiment are disposed in positions closer to the rear end of the body casing 2, so that a user can perform the operations of swinging (moving) the intermediate transfer belt 84 and detaching or attaching (replacing) the support frame 10 from the front side of the color printer 1. To sum up, the color printer 1 according to the present embodiment is easy to operate.

Although the exemplary embodiment of the present invention has been described above, it is to be understood that the present invention is not limited to the above-described embodiment. For specific implementations, various changes and modifications may be made to the exemplary embodiment of the present invention without departing from the scope of the present invention as defined in the appended claims.

Figure 8:
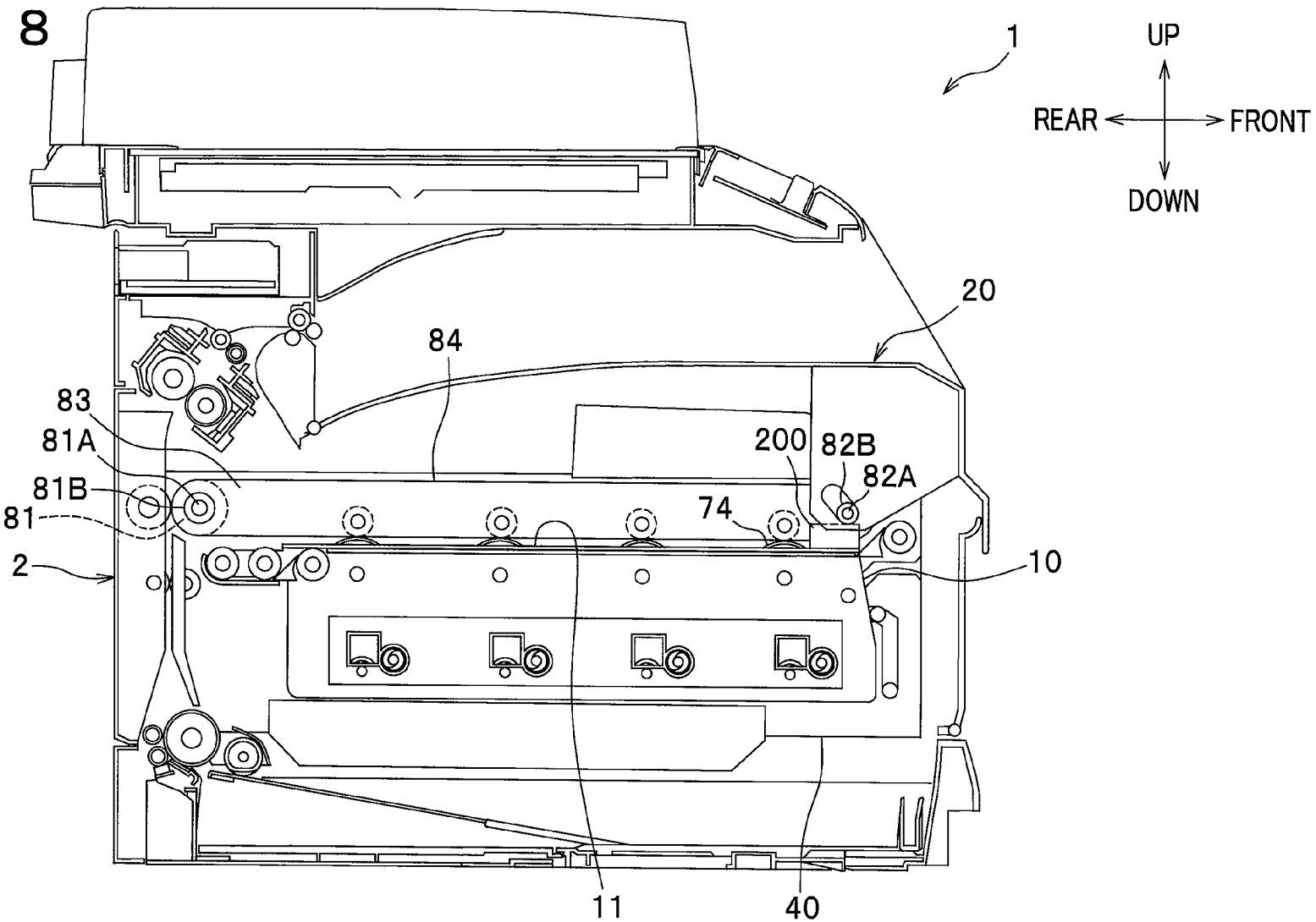
FIG. 8 is a schematic diagram of a color printer which includes a positioning portion according to another exemplary embodiment of the present invention.

For example, the positioning portion consistent with the present invention is not limited to the specific configuration (positioning portion 100) as illustrated and described above. To illustrate the simplest example, a positioning portion 200 as shown in FIG. 8 may be provided instead, which comprises a plate-like member that is rectangular in cross section and is provided on an upper surface of the flange 11 in a position closer to the front end thereof. The positioning portion 200 is, like the positioning plate 101, configured such that the bearing part 82B is brought into contact with an upper end of the positioning portion 100 so that the intermediate transfer belt 84 is retained in a position fixed relative to each of the photoconductor drums 74.

Figure 9:
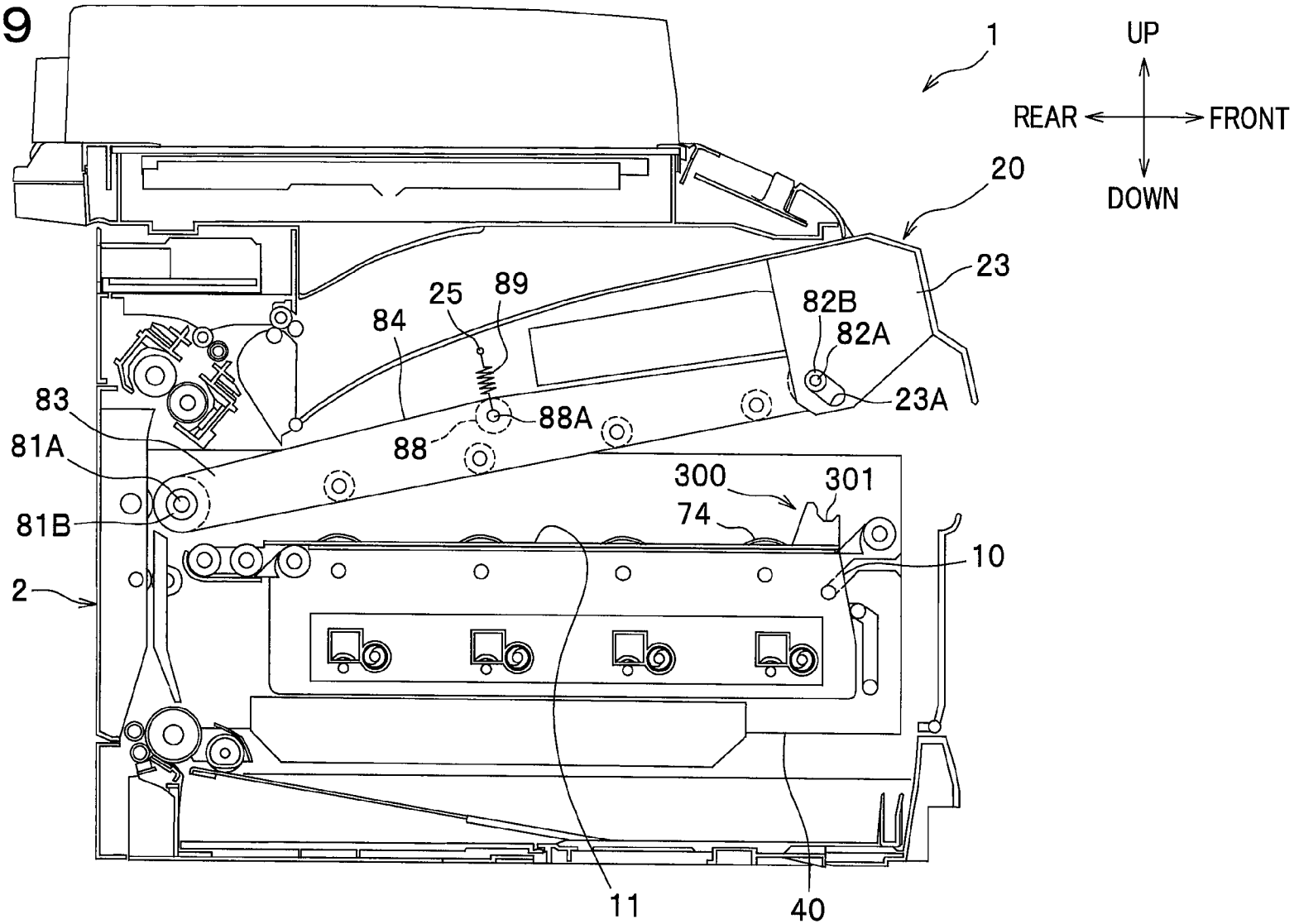
FIG. 9 is a schematic diagram of a color printer which includes a positioning portion and a tensioner according to yet another exemplary embodiment of the present invention, illustrating a state in which a front cover of the color printer has been swung open.
Figure 10:
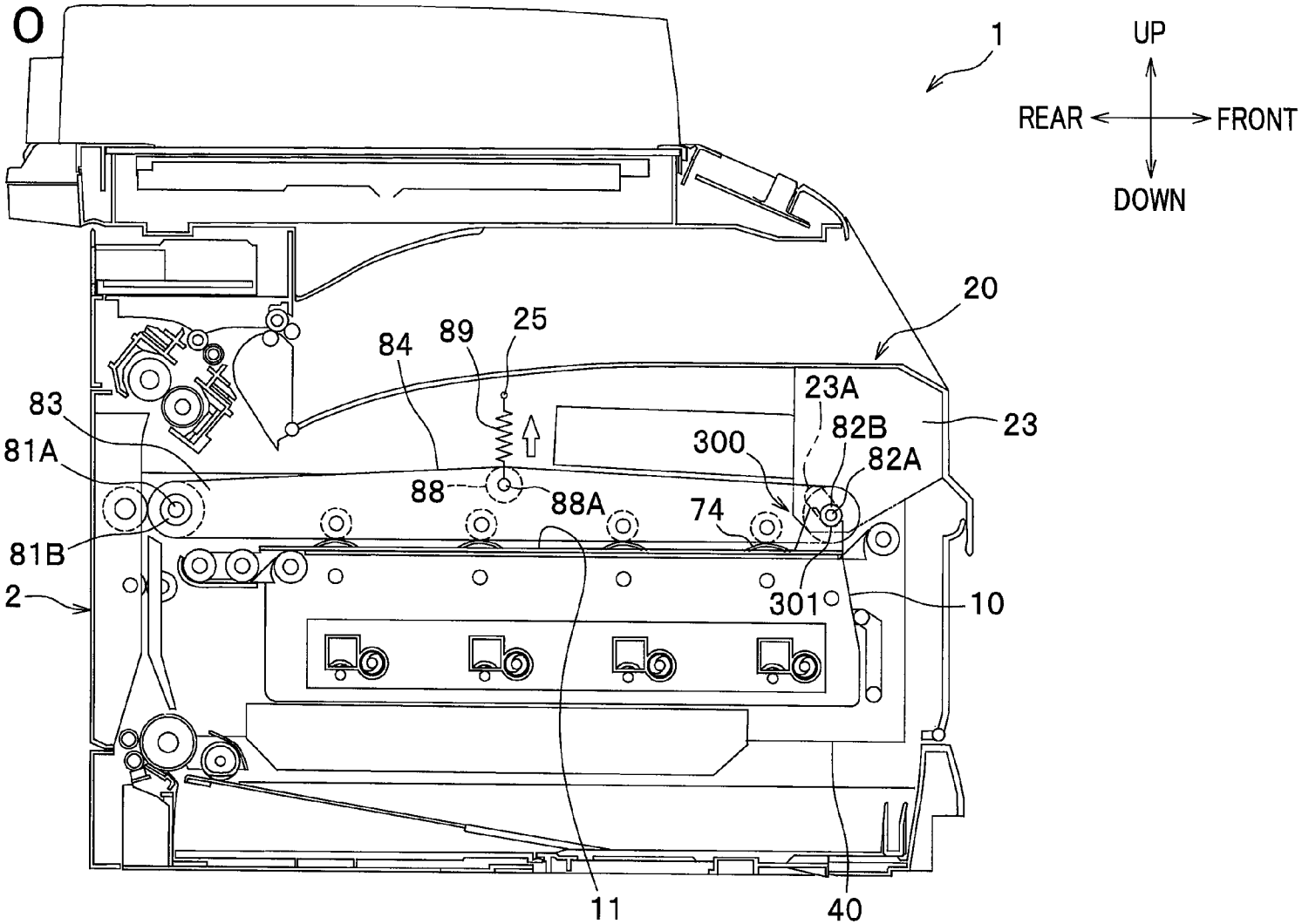
FIG. 10 is a schematic diagram of a color printer which includes a positioning portion and a tensioner according to yet another exemplary embodiment of the present invention.

The positioning portion consistent with the present invention may be a portion 300, as illustrated in FIGS. 9 and 10, which comprises a fittable portion 301 having a shape that allows the bearing part 82B of the roller shaft of the driven roller 82 to be fitted therein. With this positioning portion 300, the bearing part 82B is fitted in the fittable portion 301, and the displacement of the bearing part 82B in the front-rear direction can thus be prevented, so that the intermediate transfer belt 84 can be positioned precisely relative to each of the photoconductors 74.

Hereupon, the "shape that allows the bearing part of the roller shaft to be fitted thereto" as defined in the appended claims may be any shape which can prevent the displacement of the bearing part in the front-rear direction, that is, not limited to the shapes arcuate or semicircular or like a slit with a semicircular bottom in cross section such that the bearing part having a shape circular in cross section can be fitted neatly therein, but may encompass a variety of shapes, for example, including a shape having a corner and any other shapes such that the bearing part can be fitted thereto (therein or thereon).

Although the aforementioned exemplary embodiment adopts the pressure plate 102 and the extension spring 103 as an example of a tensioner, the present invention is not limited this specific configuration. For example, as shown in FIGS. 9 and 10, the tensioner consistent with the present invention may comprise a tension roller 88 provided slidably in contact with an inner side of an upper portion of the intermediate transfer belt 84, and an extension spring 89. With this alternative implementation, the tension roller 88 is supported in such a manner that its rotation shaft 88A is rotatable with respect to the belt frame 83 and movable vertically (i.e., allowed to be raised upward). The extension spring 89 in this embodiment has a first end connected to the rotation shaft 88A of the tension roller 88 and a second end attached to a mount portion 25 provided above the tension roller 88 within the upper cover 20.

When the upper cover 20 has been swung upward and the intermediate transfer belt 84 is in the separate position as shown in FIG. 9, the bearing part 82B has been moved relatively within the support hole 23A to a position closer to the pivot shaft 21A and thus the belt frame 83 (tension roller 88) has come closer to the mount portion 25. In this state, the extension spring 89 has recovered its original shape, so that no tension is applied to the intermediate transfer belt 84.

On the other hand, when the upper cover 20 has been closed and the intermediate transfer belt 84 is in the contact position as shown in FIG. 10, the bearing part 82B has been moved relatively within the support hole 23A to a position farther away from the pivot shaft 21A and thus the belt frame 83 (tension roller 88) has come away from the mount portion 25. In this state, the first end of the extension spring 89 is pulled downward by the rotation shaft 88A of the tension roller 88, so that the extension spring 89 urges the tension roller 88 upward (as indicated by an arrow) and a tensioning force is applied to the intermediate transfer belt 84.

Although the aforementioned embodiment shows an exemplary configuration in which the bearing part 82B for the driven roller 82 is supported by the positioning portion 100 of the support frame 10, the present invention is not limited to this specific configuration. It is to be understood that the positioning portion of the support frame may be configured to directly support the roller shaft of the driven roller (second roller).

Although the aforementioned embodiment shows an exemplary configuration in which the intermediate transfer belt 84 (transfer unit 8) is disposed above the process unit 7 (support frame 10), the present invention is not limited to this specific configuration. It is to be understood that the intermediate transfer belt may be disposed below the support frame.

Although the aforementioned embodiment shows an exemplary configuration in which the intermediate transfer belt 84 is configured to be swingable from the contact position to the separate position, the present invention is not limited to this specific configuration. For example, the intermediate transfer belt may be configured to be movable in any manner of operation, i.e., the intermediate transfer belt may be slid along a guide or translated between the contact position and the separate position.

Also in the present embodiment, a color printer 1 (so-called all-in-one or multifunction printer) having an image reading device (flatbed scanner) disposed above the body casing 2 is illustrated in the drawings (though the image reading device is not designated by reference numeral) as one example of an image forming apparatus as consistent with the present invention, but the present invention is not limited thereto. In other words, the present invention is also applicable to a photocopier, a printer without an image reading device, or anything like that.

Figure 11:
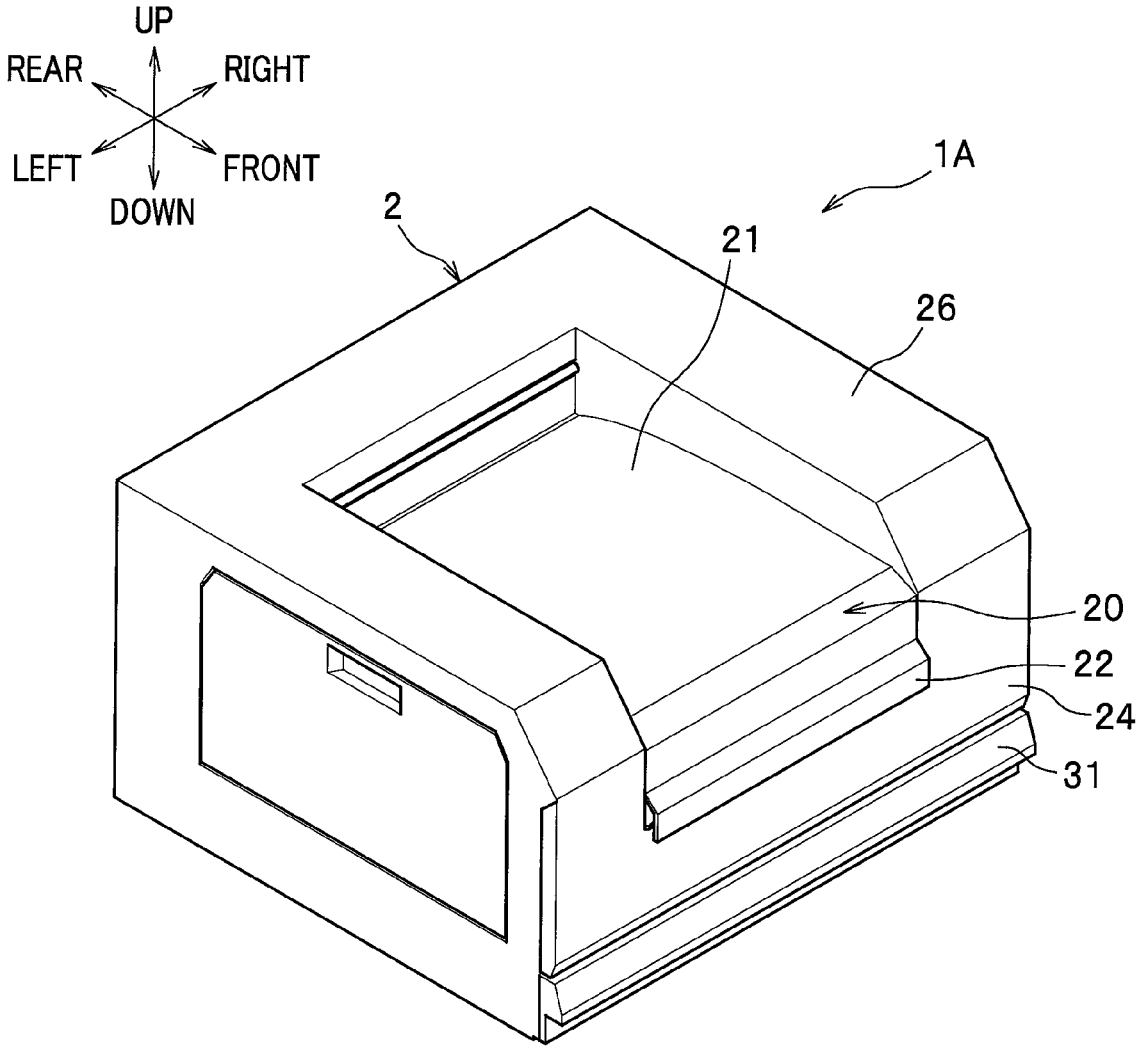
FIG. 11 is a perspective view of a color printer.

As in a color printer 1A shown in FIG. 11, at least the right and left sides of the upper cover 20 (sheet output tray 21), preferably but not necessarily, have a planar surface 26 positioned at a level higher than that of the highest portion of the bottom surface of the sheet output tray 21 when the upper cover 20 is in a closed position. This configuration carries the following advantages as compared with the image forming apparatus (hereinafter referred to as the existing apparatus) in which the top side of the body of the apparatus in its entirety constitutes an openable cover.

In the existing apparatus, an operation panel is provided at the front side of the body of the apparatus because the operation panel if provided on the cover would disadvantageously be moved according as the cover is opened or closed. Therefore, the existing apparatus should be designed such that the path along which the support frame is pulled out avoids the operation panel, and thus could have less flexibility of design. In this respect, the color printer 1A can have an operation panel (not shown) provided on the planar surface 26, and thus the path along which the support frame is pulled out can be designed more flexibly.

Furthermore, in cases where an image reading device (e.g., a flatbed scanner) is provided above the body of the apparatus, the existing apparatus may be provided with a dedicated support member for the image reading device to be installed thereon, and such a dedicated support member should be provided to protrude to the right and to the left out of the body of the apparatus. In this respect, the color printer 1A can advantageously be designed to have an image reading device installed on the flat surface 26. As a result, the color printer 1A can be designed to be compact in size (miniaturized, particularly, in the lateral direction of the body casing 2).

What is claimed is:

1. An image forming apparatus comprising:

a plurality of photoconductors;

a support frame configured to support the plurality of photoconductors arranged in the apparatus, the support frame being allowed to be pulled out from a body of the apparatus;

an endless intermediate transfer belt which is in contact with each of the plurality of photoconductors; and a first roller and a second roller around which the intermediate transfer belt is looped, wherein the first roller is supported by the body of the apparatus and retained in a position fixed relative to the body of the apparatus; and wherein the support frame comprises a positioning portion which is configured to support a roller shaft of the second roller or a bearing part of the roller shaft of the second roller and to retain the intermediate transfer belt in a position fixed relative to the plurality of photoconductors.

2. An image forming apparatus according to claim 1, further comprising a secondary transfer roller disposed in a position opposite to the first roller such that the intermediate transfer belt is held between the secondary transfer roller and the first roller, wherein the secondary transfer roller is supported by the body of the apparatus.

3. An image forming apparatus according to claim 1, wherein the intermediate transfer belt is configured to be swingable on an axis of rotation of the first roller between a contact position in which the intermediate transfer belt is in contact with the each of the plurality of photoconductors and a separate position in which the intermediate transfer belt is separate from the each of the plurality of photoconductors.

4. An image forming apparatus according to claim 1, further comprising a tensioner configured to apply a tensioning force to the intermediate transfer belt.

5. An image forming apparatus according to claim 4, wherein the tensioner is configured to urge the second roller toward a direction away from the first roller.

6. An image forming apparatus according to claim 1, wherein the positioning portion has a shape that allows the roller shaft of the second roller or the bearing part of the roller shaft of the second roller to be fitted thereto.

7. An image forming apparatus according to claim 3, further comprising a residual developer collecting member disposed opposite to the intermediate transfer belt and configured to collect developer remaining on the intermediate transfer belt, wherein the residual developer collecting member is movable together with the intermediate transfer belt.

8. An image forming apparatus according to claim 3, wherein the second roller is located in a first position closer to a first end of the support frame facing toward a pull-out direction in which the support frame is allowed to be pulled out, and the first roller is located in a second position closer to a second end of the support frame facing toward a direction opposite to the pull-out direction.

* * * * *